US009929465B2

(12) United States Patent
Tang et al.

(10) Patent No.: US 9,929,465 B2
(45) Date of Patent: Mar. 27, 2018

(54) ANTENNA ARRAY AND PHASED ARRAY SYSTEM TO WHICH ANTENNA ARRAY IS APPLIED

(71) Applicant: HUAWEI TECHNOLOGIES CO., LTD., Shenzhen (CN)

(72) Inventors: Fusheng Tang, Segrate (IT); Yanxing Luo, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 218 days.

(21) Appl. No.: 15/084,010

(22) Filed: Mar. 29, 2016

(65) Prior Publication Data

US 2016/0211575 A1 Jul. 21, 2016

Related U.S. Application Data

(63) Continuation of application No. PCT/CN2013/084713, filed on Sep. 30, 2013.

(51) Int. Cl.

| | |
|---|---|
| ***H01Q 3/26*** | (2006.01) |
| ***H01Q 1/52*** | (2006.01) |
| ***H01Q 21/06*** | (2006.01) |

(52) U.S. Cl.

CPC ..... *H01Q 1/523* (2013.01); *H01Q 1/525* (2013.01); *H01Q 21/064* (2013.01); *H01Q 3/26* (2013.01)

(58) Field of Classification Search

CPC ..... H01Q 1/525; H01Q 21/064; H01Q 1/523; H01Q 3/26

USPC ..... 343/841

See application file for complete search history.

(56) References Cited

U.S. PATENT DOCUMENTS 8,014,745 B1 9/2011 Ho et al.

FOREIGN PATENT DOCUMENTS

| | | | |
|---|---|---|---|
| CN | 2935505 | Y | 8/2007 |
| CN | 102544728 | A | 7/2012 |
| CN | 102709681 | A | 10/2012 |
| CN | 102832452 | A | 12/2012 |
| CN | 102955151 | A | 3/2013 |

(Continued)

OTHER PUBLICATIONS

Xiang-yu et al., "An analysis of the mutual coupling between the coaxial multi-mode horn of two chokes in the near-field", Journal of Xidian University, vol. 28, No. 5, China Academic Journal Electronic Publishing House, Oct. 2001, 4 pages.

(Continued)

*Primary Examiner* — Andrea Lindgren Baltzell
(74) *Attorney, Agent, or Firm* — Staas & Halsey LLP

(57) ABSTRACT

The present invention provides an antenna array, including a first antenna group, a second antenna group, and a transition band, where the transition band is located between the first antenna group and the second antenna group and is connected to the first antenna group and the second antenna group, a height of the transition band is less than or equal to a height of the first antenna group and a height of the second antenna group, the transition band includes a first transition sheet and a second transition sheet, one end of the first transition sheet is connected to one end of the second transition sheet to form the transition band of a V-shaped structure, and the other end of the first transition sheet is connected to the first antenna group. The present invention further provides a phased array system to which the antenna array is applied.

19 Claims, 3 Drawing Sheets

(56) References Cited

FOREIGN PATENT DOCUMENTS

| | | |
|---|---|---|
| EP | 2 003 729 A2 | 12/2008 |
| GB | 2 390 225 A | 12/2003 |

OTHER PUBLICATIONS

Chinese Search Report dated Apr. 12, 2016 in corresponding Chinese Patent Application No. 2013800013452.
Chinese Office Action dated Apr. 20, 2016 in corresponding Chinese Patent Application No. 201380001345.2.
International Search Report dated Jul. 2, 2014 in corresponding International Patent Application No. PCT/CN2013/084713.
Extended European Search Report dated Aug. 3, 2016 in corresponding European Patent Application No. 13894270.1.
International Search Report dated Jul. 2, 2014 in corresponding International Application PCT/CN2013/084713.

ANTENNA ARRAY AND PHASED ARRAY SYSTEM TO WHICH ANTENNA ARRAY IS APPLIED

CROSS-REFERENCE TO RELATED APPLICATIONS

This application is a continuation of International Application No. PCT/CN2013/084713, filed on Sep. 30, 2013, which is hereby incorporated by reference in its entirety.

TECHNICAL FIELD

The present invention relates to the field of communications devices, and in particular, to an antenna array and a phased array system to which the antenna array is applied.

BACKGROUND

An antenna array is an antenna array formed by feeding and spatially arranging, according to a requirement, two or more antennas working at a same frequency, for example, for a phased array antenna (Phased Array Antenna, PAA), relative phases of feeding signals are changed, so as to achieve an objective of spatial beam scanning. In a phased array system in which frequency division duplex (Frequency Division Duplex, FDD) is used and receiving and transmitting of a signal use different antennas or different PAAs, based on a size requirement of the system, a distance between transmit and receive antennas (arrays) is relatively small; therefore, in this case, isolation between the two antennas (arrays) can hardly satisfy the requirement of the system, thereby causing that signal interference between the transmit antenna (array) and the receive antenna (array) is relatively large, which cannot satisfy a normal operation requirement of the system.

In the prior art, the following solutions are mostly used to increase isolation between antennas (arrays), but all the solutions can hardly satisfy an entire requirement of a system. (1) A unit gain of an antenna (array) is increased, where the increase in the gain of the antenna can increase isolation to some extent, but cannot satisfy an requirement imposed by a phased array system on an angle of spatial beam scanning, and a size of the antenna needs to be increased at the same time, which leads to an increase in a size of the system; therefore, a size requirement of the system cannot be satisfied; (2) A distance between transmit and receive antennas (arrays) is increased, where due to a limitation of the size requirement of the phased array system, the increase in the distance between the transmit and receive antennas (arrays) cannot satisfy the requirement either; and (3) An appropriate filter is disposed at a rear end of a receive antenna (array), where disposing of more filters not only may increase costs of the system, but also may occupy more area of a radio frequency board, so that the size of the system cannot be controlled to be within an expected range. Therefore, the existing solutions of increasing isolation of an antenna (array) cannot satisfy an actual requirement.

SUMMARY

In view of this, the present invention provides an antenna array, which solves, under the premise that a size is not increased and beamforming and beam scanning of an array are not affected, a problem that isolation between transmit and receive antennas (arrays) in a phased array system is insufficient.

The present invention further provides a phased array system to which the antenna array is applied.

According to a first aspect, an antenna array is provided, including a first antenna group, a second antenna group, and a transition band, where the transition band is located between the first antenna group and the second antenna group and is connected to the first antenna group and the second antenna group, a height of the transition band is less than or equal to a height of the first antenna group and a height of the second antenna group, the transition band includes a first transition sheet and a second transition sheet, one end of the first transition sheet is connected to one end of the second transition sheet to form the transition band of a V-shaped structure, and the other end of the first transition sheet is connected to the first antenna group.

In a first possible implementation manner of the first aspect, the first transition sheet is connected to the second transition sheet to form a V-shaped groove; and when there is one transition band, one end of the first transition sheet of the transition band is connected to one end of the second transition sheet, the other end of the first transition sheet is connected to the first antenna group, the other end of the second transition sheet is connected to the second antenna group, and a width of the groove is equal to a distance between the first antenna group and the second antenna group.

In a second possible implementation manner of the first aspect, the first transition sheet is connected to the second transition sheet to form a V-shaped groove; and when there are two or more transition bands, the transition bands are connected in a head-to-tail manner, a second transition sheet of one transition band is connected to a first transition sheet of a next transition band, a first transition sheet of a transition band located in the first place is connected to the first antenna group, a second transition sheet of a transition band located in the last place is connected to the second antenna group, and a sum of widths of grooves is equal to a distance between the first antenna group and the second antenna group.

In a third possible implementation manner of the first aspect, the first antenna group includes several transmit antennas, each transmit antenna includes a first transmit port diametric plane and a second transmit port diametric plane, and the first transmit port diametric plane and the second transmit port diametric plane are end surfaces of two opposite ends of the transmit antenna and are parallel to each other; and the second antenna group includes several receive antennas, each receive antenna includes a first receive port diametric plane and a second receive port diametric plane, and the first receive port diametric plane and the second receive port diametric plane are end surfaces of two opposite ends of the receive antenna and are parallel to each other.

With reference to the third possible implementation manner of the first aspect, in a fourth possible implementation manner, either of the transmit antenna and the receive antenna is any kind of: a pyramidal horn antenna, a slotted waveguide antenna, and a helical antenna.

With reference to the third possible implementation manner of the first aspect, in a fifth possible implementation manner, the first transition sheet is connected to the second transition sheet to form a V-shaped groove; and when there is one transition band, the first transition sheet and the second transition sheet of the transition band are connected to an edge of the first transmit port diametric plane of the transmit antenna and an edge of the first receive port diametric plane of the receive antenna respectively, to connect the transmit antenna and the receive antenna, and a width of the groove is equal to a distance between the first transmit port diametric plane and the first receive port diametric plane.

With reference to the third possible implementation manner of the first aspect, in a sixth possible implementation manner, the first transition sheet is connected to the second transition sheet to form a V-shaped groove; and when there are two or more transition bands, the transition bands are connected in a head-to-tail manner, a first transition sheet of a transition band located in the first place is connected to an edge of the first transmit port diametric plane of the transmit antenna, a second transition sheet of a transition band located in the last place is connected to an edge of the first receive port diametric plane of the receive antenna, and a sum of widths of grooves of the transition bands is equal to a distance between the first transmit port diametric plane and the first receive port diametric plane.

With reference to the third possible implementation manner of the first aspect, in a seventh possible implementation manner, a distance between the first transmit port diametric plane and the second transmit port diametric plane of the transmit antenna is equal to the height of the first antenna group, the height of the transition band is less than or equal to the distance between the first transmit port diametric plane and the second transmit port diametric plane of the transmit antenna, and the transition band is located between the first transmit port diametric plane and the second transmit port diametric plane; and a distance between the first receive port diametric plane and the second receive port diametric plane of the receive antenna is equal to the height of the second antenna group, the height of the transition band is less than or equal to the distance between the first receive port diametric plane and the second receive port diametric plane of the receive antenna, and the transition band is located between the first receive port diametric plane and the second receive port diametric plane.

In an eighth possible implementation manner of the first aspect, heights of transition bands are different, and the transition bands are arranged between the first antenna group and the second antenna group in descending order of height, or arranged between the first antenna group and the second antenna group in ascending order of height.

In a ninth possible implementation manner of the first aspect, the entire transition band is of a symmetric V-shaped structure.

In a tenth possible implementation manner of the first aspect, the transition band is a bent sheet body made of any kind of: copper, iron, and aluminum.

According to a second aspect, a phased array system is provided, including a signal transmitter, a signal receiver, and an antenna array, where the antenna array includes a first antenna group and a second antenna group, and the first antenna group and the second antenna group are electrically connected to the signal transmitter and the signal receiver respectively; and the antenna array further includes a transition band, the transition band is located between the first antenna group and the second antenna group and is connected to the first antenna group and the second antenna group, a height of the transition band is less than or equal to a height of the first antenna group and a height of the second antenna group, the transition band includes a first transition sheet and a second transition sheet, one end of the first transition sheet is connected to one end of the second transition sheet to form the transition band of a V-shaped structure, and the other end of the first transition sheet is connected to the first antenna group.

In a first possible implementation manner of the second aspect, the first transition sheet is connected to the second transition sheet to form a V-shaped groove; and when there is one transition band, one end of the first transition sheet of the transition band is connected to one end of the second transition sheet, the other end of the first transition sheet is connected to the first antenna group, the other end of the second transition sheet is connected to the second antenna group, and a width of the groove is equal to a distance between the first antenna group and the second antenna group.

In a second possible implementation manner of the second aspect, the first transition sheet is connected to the second transition sheet to form a V-shaped groove; and when there are two or more transition bands, the transition bands are connected in a head-to-tail manner, a second transition sheet of one transition band is connected to a first transition sheet of a next transition band, a first transition sheet of a transition band located in the first place is connected to the first antenna group, a second transition sheet of a transition band located in the last place is connected to the second antenna group, and a sum of widths of grooves is equal to a distance between the first antenna group and the second antenna group.

In a third possible implementation manner of the second aspect, the first antenna group includes several transmit antennas, each transmit antenna includes a first transmit port diametric plane and a second transmit port diametric plane, and the first transmit port diametric plane and the second transmit port diametric plane are end surfaces of two opposite ends of the transmit antenna and are parallel to each other; and the second antenna group includes several receive antennas, each receive antenna includes a first receive port diametric plane and a second receive port diametric plane, and the first receive port diametric plane and the second receive port diametric plane are end surfaces of two opposite ends of the receive antenna and are parallel to each other.

In a fourth possible implementation manner of the second aspect, either of the transmit antenna and the receive antenna is any kind of: a pyramidal horn antenna, a slotted waveguide antenna, and a helical antenna.

In a fifth possible implementation manner of the second aspect, the first transition sheet is connected to the second transition sheet to form a V-shaped groove; and when there is one transition band, the first transition sheet and the second transition sheet of the transition band are connected to an edge of the first transmit port diametric plane of the transmit antenna and an edge of the first receive port diametric plane of the receive antenna respectively, to connect the transmit antenna and the receive antenna, and a width of the groove is equal to a distance between the first transmit port diametric plane and the first receive port diametric plane.

In a sixth possible implementation manner of the second aspect, the first transition sheet is connected to the second transition sheet to form a V-shaped groove; and when there are two or more transition bands, the transition bands are connected in a head-to-tail manner, a first transition sheet of a transition band located in the first place is connected to an edge of the first transmit port diametric plane of the transmit antenna, a second transition sheet of a transition band located in the last place is connected to an edge of the first receive port diametric plane of the receive antenna, and a sum of widths of grooves of the transition bands is equal to a distance between the first transmit port diametric plane and the first receive port diametric plane.

In a seventh possible implementation manner of the second aspect, a distance between the first transmit port diametric plane and the second transmit port diametric plane of the transmit antenna is equal to the height of the first antenna group, the height of the transition band is less than or equal to the distance between the first transmit port diametric plane and the second transmit port diametric plane of the transmit antenna, and the transition band is located between the first transmit port diametric plane and the second transmit port diametric plane; and a distance between the first receive port diametric plane and the second receive port diametric plane of the receive antenna is equal to the height of the second antenna group, the height of the transition band is less than or equal to the distance between the first receive port diametric plane and the second receive port diametric plane of the receive antenna, and the transition band is located between the first receive port diametric plane and the second receive port diametric plane.

In an eighth possible implementation manner of the second aspect, heights of transition bands are different, and the transition bands are arranged between the first antenna group and the second antenna group in descending order of height, or arranged between the first antenna group and the second antenna group in ascending order of height.

In a ninth possible implementation manner of the second aspect, the entire transition band is of a symmetric V-shaped structure.

In a tenth possible implementation manner of the second aspect, the transition band is a bent sheet body made of any kind of: copper, iron, and aluminum.

In an eleventh possible implementation manner of the second aspect, the signal transmitter includes:

a signal transmitting module, configured to generate and send a radio frequency signal;

a power splitter, electrically connected to the signal transmitting module; and configured to receive the signal input by the signal transmitting module, and split the input signal energy into two or more channels of signals outputting equal or unequal energy;

several phase shifters, each electrically connected to the power splitter; and receiving the signals output by the power splitter, and adjusting phases of the signals; and several power amplifiers, each electrically connected to each corresponding phase shifter and the first antenna group; and configured to receive the signals output by the phase shifters, and amplify the signals output by the phase shifters, to obtain signals applied to the first antenna group.

In a twelfth possible implementation manner of the second aspect, the signal receiver includes:

several low noise amplifiers, electrically connected to the second antenna group; and receiving a signal from the second antenna group, and amplifying the signal;

several phase shifters, each electrically connected to each corresponding low noise amplifier; and configured to receive signals output by the low noise amplifiers, and adjust phases of the signals;

a combiner, electrically connected to the phase shifters; and receiving two or more channels of signals input by the phase shifters, and combining the input two or more channels of signal energy into one channel of output signal; and a signal receiving module, electrically connected to the combiner; and receiving the signal input by the combiner, storing the signal, and providing the signal for the phased array system to use.

According to the embodiments of the present invention, in a phased array system described in the present invention, an antenna array may be used in the phased array system in which a distance between receive and transmit antennas is relatively small and an isolation requirement is relatively high, and has the following beneficial effects: (1) under the premise that a size is not increased and beamforming and beam scanning of an array are not affected, a problem that isolation between transmit and receive antennas (arrays) in a phased array system, especially in a small-scale microwave system, is insufficient is solved; (2) the antenna array is integrated into the phased array system, a distance between the transmit and receive antennas (arrays) and sizes of the antennas do not need to be increased; therefore, a size of the phased array system is not increased either; and (3) no filter needs to be disposed at a rear end of the receive antenna (array), and a cost of the antenna array is low; therefore, an entire system cost is reduced, relatively small area of a radio frequency board is occupied, and the size of the system can be controlled to be within an expected range.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Figure 1:
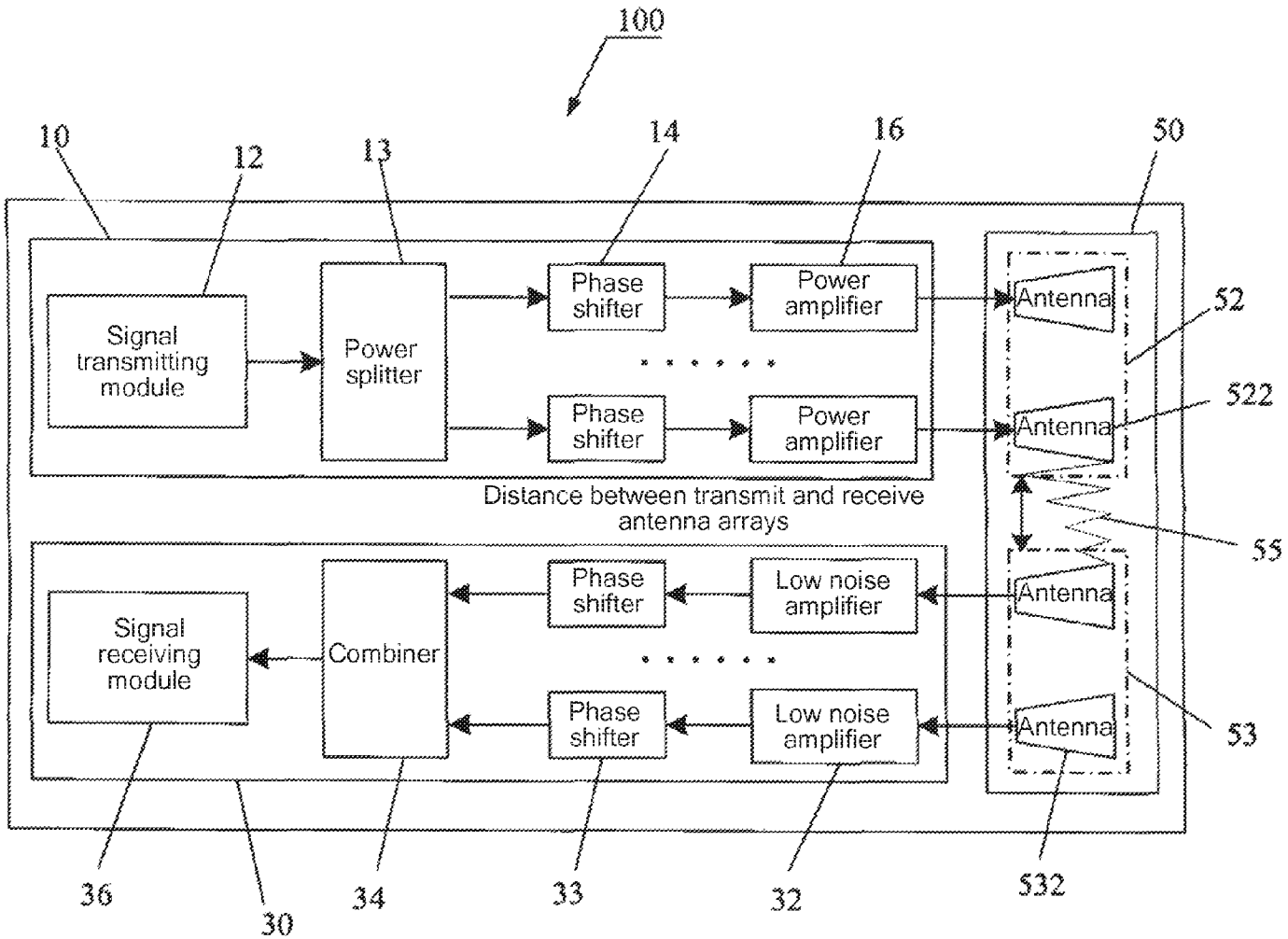
FIG. 1 is a circuit block diagram of a phased array system according to an embodiment of the present invention.

Referring to FIG. 1, FIG. 1 is a circuit block diagram of a phased array system 100 according to an embodiment of the present invention. The phased array system 100 may include at least a signal transmitter 10, a signal receiver 30, and an antenna array 50. The antenna array 50 is electrically connected to the signal transmitter 10 and the signal receiver 30, to transfer a signal.

In this embodiment of the present invention, the signal transmitter 10 is electrically connected to the antenna array 50, and can process (for example, filtering, phase shifting, and amplifying) a signal and transmit a processed signal at a frequency. Specifically, the signal transmitter 10 may include at least a signal transmitting module 12, a power splitter 13, several phase shifters 14, and several power amplifiers 16.

In this embodiment of the present invention, the signal transmitting module 12 may be a signal generator (for example, a radio frequency signal generator), and is configured to generate and send a radio frequency signal. The power splitter 13 is electrically connected to the signal transmitting module 12, receives the signal input by the signal transmitting module 12, and splits the input signal energy into two or more channels of signals outputting equal or unequal energy.

In this embodiment of the present invention, the phase shifters 14 each are electrically connected to the power splitter 13, receive the signals output by the power splitter 13, and adjust phases of the signals. A quantity of the power amplifiers 16 is the same as a quantity of the phase shifters 14, and the power amplifiers 16 each are electrically connected to each corresponding phase shifter 14. The power amplifiers 16 receive the signals output by the phase shifters 14, and amplify the signals output by the phase shifters 14, to obtain signals suitable for the antenna array 50.

In this embodiment of the present invention, the signal receiver 30 is electrically connected to the antenna array 50, and may receive a signal from the antenna array 50 and process (for example, amplifying, phase shifting, and filtering) the signal, to convert a processed signal into a signal suitably used by the phased array system 100. Specifically, the signal receiver 30 may include at least several low noise amplifiers 32, several phase shifters 33, a combiner 34, and a signal receiving module 36.

In this embodiment of the present invention, the low noise amplifier 32 is electrically connected to the antenna array 50, and may receive a signal from the antenna array 50 and amplify the signal, for processing by a subsequent electronic device. Specifically, because a signal from the antenna array 50 generally is relatively weak, the low noise amplifier 32 is mostly disposed at a position near the antenna array 50, so as to reduce a loss generated when the signal passes through a transmission line.

A quantity of the phase shifters 33 is the same as a quantity of the low noise amplifiers 32, and the phase shifters 33 each are electrically connected to each corresponding low noise amplifier 32. The phase shifters 33 receive signals output by the low noise amplifiers 32, and adjust phases of the signals.

In this embodiment of the present invention, the combiner 34 is electrically connected to the phase shifters 33; and receives two or more channels of signals input by the phase shifters 33, and combines the input two or more channels of signal energy into one channel of output signal. The signal receiving module 36 is electrically connected to the combiner 34; and receives the signal input by the combiner 34, and stores the signal, for the phased array system 100 to use.

Figure 2:
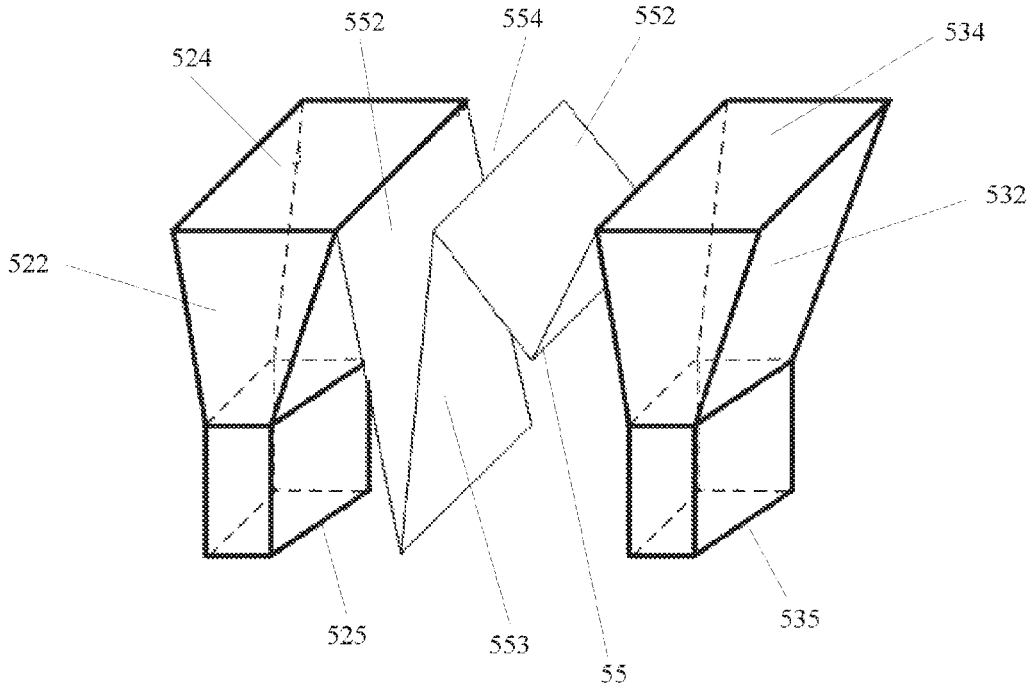
FIG. 2 is a three-dimensional schematic diagram in which a transition band in an antenna array is connected between a signal transmit antenna and a signal receive antenna according to an embodiment of the present invention.

Referring to FIG. 2, in this embodiment of the present invention, the antenna array 50 includes, but is not limited to: a pyramidal horn antenna array, a slotted waveguide antenna array, and a helical antenna array. The antenna array 50 includes at least a first antenna group 52, a second antenna group 53, and at least one transition band 55 located between the first antenna group 52 and the second antenna group 53. When a frequency division duplex (Frequency Division Duplex, FDD) mode is used for signal transmission, the first antenna group 52 and the second antenna group 53 are located in a same site and are connected by using the transition band 55, so as to increase isolation of the antenna array 50, and avoid signal interference between the first antenna group 52 and the second antenna group 53.

In this embodiment of the present invention, the first antenna group 52 is electrically connected to the power amplifiers 16 of the signal transmitter 10, and is used as a signal transmit antenna for transmitting a signal. The first antenna group 52 includes several transmit antennas 522, a quantity of the transmit antennas 522 is equal to the quantity of the power amplifiers 16, and the transmit antennas 522 each are electrically connected to each corresponding power amplifier 16, so as to transmit signals input by the power amplifiers 16. In another embodiment of the present invention, the several transmit antennas 522 of the first antenna group 52 may be an antenna array formed by feeding and spatially arranging, according to a requirement, antennas working at a same frequency, and the transmit antennas 522 are antenna radiation units forming the antenna array. Correspondingly, the transmit antennas 522 include, but are not limited to: pyramidal horn antennas, slotted waveguide antennas, and helical antennas, that is, the transmit antennas 522 are any kind of: pyramidal horn antennas, slotted waveguide antennas, and helical antennas. This embodiment of the present invention is described by using an example in which the transmit antennas 522 are pyramidal horn antennas.

In this embodiment of the present invention, the transmit antenna 522 is a pyramidal horn antenna, and the transmit antenna 522 includes a first transmit port diametric plane 524 and a second transmit port diametric plane 525. The first transmit port diametric plane 524 and the second transmit port diametric plane 525 are end surfaces of two opposite ends of the transmit antenna 522 and are parallel to each other. A distance between the first transmit port diametric plane 524 and the second transmit port diametric plane 525 is a height of the transmit antenna 522. First transmit port diametric planes 524 of the several transmit antennas 522 of the first antenna group 52 are all on a same plane; and second transmit port diametric planes 525 of the several transmit antennas 522 are all on a same plane, where the plane is parallel to the plane on which the first transmit port diametric planes 524 are located.

In this embodiment of the present invention, the second antenna group 53 is electrically connected to the low noise amplifiers 32 of the signal receiver 30, and is used as a signal receive antenna for receiving a signal. The second antenna group 53 includes several receive antennas 532, a quantity of the receive antennas 532 is equal to the quantity of the low noise amplifiers 32, and the receive antennas 532 each are electrically connected to each corresponding low noise amplifier 32, so as to transmit a received signal to the low noise amplifier 32 for subsequent processing. In another embodiment of the present invention, the several receive antennas 532 of the second antenna group 53 may be an antenna array formed by feeding and spatially arranging, according to a requirement, antennas working at a same frequency, and the receive antennas 532 are antenna radiation units forming the antenna array. Correspondingly, the receive antennas 532 include, but are not limited to: pyramidal horn antennas, slotted waveguide antennas, and helical antennas, that is, the receive antennas 532 are any kind of: pyramidal horn antennas, slotted waveguide antennas, and helical antennas. This embodiment of the present invention is described by using an example in which the receive antennas 532 are pyramidal horn antennas.

In this embodiment of the present invention, the receive antenna 532 is a pyramidal horn antennas, and the receive antenna 532 includes a first receive port diametric plane 534 and a second receive port diametric plane 535. The first receive port diametric plane 534 and the second receive port diametric plane 535 are end surfaces of two opposite ends of the receive antenna 532 and are parallel to each other. A distance between the first receive port diametric plane 534 and the second receive port diametric plane 535 is a height of the receive antenna 532. First receive port diametric planes 534 of the several receive antennas 532 of the second antenna group 53 are all on a same plane; and second receive port diametric planes 535 of the several receive antennas 532 are all on a same plane, where the plane is parallel to the plane on which the first receive port diametric planes 534 are located.

In this embodiment of the present invention, the first receive port diametric planes 534 of the several receive antennas 532 of the second antenna group 53 and the first transmit port diametric planes 524 of the several transmit antennas 522 of the first antenna group 52 are on a same plane; and correspondingly, the second receive port diametric planes 535 of the several receive antennas 532 of the second antenna group 53 and the second transmit port diametric planes 525 of the several transmit antennas 522 of the first antenna group 52 are on a same plane.

In this embodiment of the present invention, the transition band 55 may be formed by bending a metal sheet, and specifically, the transition band 55 may be a sheet body made of any kind of: copper, iron, aluminum, and alloy thereof. The transition band 55 is disposed between the first antenna group 52 and the second antenna group 53. Specifically, the transition band 55 is located between the transmit antenna 522 of the first antenna group 52 and the receive antenna 532 of the second antenna group 53 that are adjacent to each other, and two ends of the transition band 55 are physically connected to an edge of the first transmit port diametric plane 524 of the transmit antenna 522 and an edge of the first receive port diametric plane 534 of the receive antenna 532 respectively.

In an embodiment of the present invention, each of the transition bands 55 is roughly in a V shape entirely, and may be formed by bending a metal sheet made of copper, iron, or aluminum. Each transition band 55 includes a first transition sheet 552 and a second transition sheet 553. One end of the first transition sheet 552 is connected to one end of the second transition sheet 553 to form the entirely V-shaped transition band 55, and a V-shaped groove 554 is formed between the first transition sheet 552 and the second transition sheet 553. When there is one transition band 55, one end of the first transition sheet 552 of the transition band 55 is connected to one end of the second transition sheet 553, the other end of the first transition sheet 552 is connected to the first antenna group 52, the other end of the second transition sheet 553 is connected to the second antenna group 53, and a width of the groove 554 is equal to a distance between the first antenna group 52 and the second antenna group 53. Specifically, the first transition sheet 552 and the second transition sheet 553 of the transition band 55 are connected to the edge of the first transmit port diametric plane 524 of the transmit antenna 522 and the edge of the first receive port diametric plane 534 of the receive antenna 532 respectively, to connect the transmit antenna 522 and the receive antenna 532. The width of the groove 554 is equal to a distance between the first transmit port diametric plane 524 and the first receive port diametric plane 534. When there are two, three, four, or more transition bands 55, the transition bands 55 are connected in a head-to-tail manner, that is, a second transition sheet 553 of one transition band 55 is connected to a first transition sheet 552 of a next transition band 55, a first transition sheet 552 of a transition band 55 located in the first place is connected to the first antenna group 52, a second transition sheet 553 of a transition band 55 located in the last place is connected to the second antenna group 53, and a sum of widths of grooves 554 is equal to the distance between the first antenna group 52 and the second antenna group 53. Specifically, a second transition sheet 553 of one transition band 55 is connected to a first transition sheet 552 of a next transition band 55, and so on, a first transition sheet 552 of a transition band 55 located in the first place is connected to the edge of the first transmit port diametric plane 524 of the transmit antenna 522, a second transition sheet 553 of a transition band 55 located in the last place is connected to the edge of the first receive port diametric plane 534 of the receive antenna 532, and the sum of the widths of the grooves 554 of the transition bands 55 is equal to the distance between the first transmit port diametric plane 524 and the first receive port diametric plane 534.

In this embodiment of the present invention, a height of each of the transition bands 55 is less than or equal to the height of the transmit antenna 522, that is, the height of the transition band 55 is less than or equal to the distance between the first transmit port diametric plane 524 and the second transmit port diametric plane 525 of the transmit antenna 522, and the transition band 55 is located between the first transmit port diametric plane 524 and the second transmit port diametric plane 525. Correspondingly, the height of each of the transition bands 55 is less than or equal to the height of the receive antenna 532, that is, the height of the transition band 55 is less than or equal to the distance between the first receive port diametric plane 534 and the second receive port diametric plane 535 of the receive antenna 532, and the transition band 55 is located between the first receive port diametric plane 534 and the second receive port diametric plane 535. Based on the foregoing design, the transition band 55 does not affect beamforming or beam scanning, but plays a role of wave trapping; therefore, field distribution formed by a current of the transmit port diametric plane on the receive port diametric plane becomes weak, thereby reducing strength of a signal sneaking onto the receive port diametric plane, and further increasing isolation of the antenna array 50. A specific theory may be deduced as follows:

It is set that a wave number in free space is k, and that wave impedance is t, and when no transition band 55 is disposed between the first antenna group 52 and the second antenna group 53, equivalent surface current distribution and magnetic current distribution of the transmit port diametric plane are $\vec{J}_T^{(1)}$ and $\vec{M}_T^{(1)}$ respectively, and equivalent surface current distribution and magnetic current distribution of the receive port diametric plane are $\vec{J}_R^{(1)}$ and $\vec{M}_R^{(1)}$ respectively; or when the transition band 55 is disposed between the first antenna group 52 and the second antenna group 53, equivalent surface current distribution and magnetic current distribution of the transmit port diametric plane are $\vec{J}_T^{(2)}$ and $\vec{M}_T^{(2)}$ respectively, and equivalent surface current distribution and magnetic current distribution of the receive port diametric plane are $\vec{J}_R^{(2)}$ and $\vec{M}_R^{(2)}$ respectively, and then, equivalent surface current distribution of a surface of the transition band 55 is $\vec{J}_V$.

According to a relationship between a field and a source, and a boundary condition of continuity of a tangential electric field, when no transition band 55 is disposed between the first antenna group 52 and the second antenna group 53, the following integral equation is satisfied for the electric field $\vec{E}_V^{(1)}$ on a mathematical surface $S_V$ of the surface of the transition band 55:

$$\hat{n}\times L^E(\vec{J}_T^{(1)}, \vec{M}_T^{(1)})|_{r\in S_V} + \hat{n}\times L^E(\vec{J}_R^{(1)}, \vec{M}_R^{(1)})|_{r\in S_V} = \hat{n}\times \vec{E}_V^{(1)}|_{r\in S_V} \quad \text{Formula (1)}$$

where:

$$L^E(\vec{J}, \vec{M}) = jk\eta\hat{n}\times \int\left[1+\frac{1}{k^2}\nabla\nabla\cdot\right]\vec{J}(\vec{r}')G(\vec{r}\mid\vec{r}')dS' + \int \vec{M}(\vec{r}')\times\nabla G(\vec{r}\mid\vec{r}')dS' \quad \text{Formula (2)}$$

and $$G(\vec{r}\mid\vec{r}') = e^{-jk|\vec{r}-\vec{r}'|}/|\vec{r}-\vec{r}'|. \quad \text{Formula (3)}$$

When the transition band 55 is disposed between the first antenna group 52 and the second antenna group 53, according to continuity of the electric field and an ideal conductor boundary condition on the surface of the transition band 55, the following integral equation is satisfied for the electric field $\vec{E}_V^{(1)}$ on a mathematical surface $S_V$ of the surface of the transition band 55:

$$\hat{n}\times L^E(\vec{J}_T^{(2)},\vec{M}_T^{(2)})|_{P\in S_V}+\hat{n}\times L^E(\vec{J}_R^{(2)}, \vec{M}_R^{(2)})|_{P\in S_V}+\hat{n}\times L^E(\vec{J}_V,0)|_{P\in S_V}=\hat{n}\times\vec{E}_V^{(2)}|_{P\in S_V}=0 \quad \text{Formula (4).}$$

Actually, field distribution on the transmit port diametric plane mainly depends on a feeding status of the transmit port diametric plane, impact of existence of the V-shaped transition band 55 below the transmit port diametric plane on the transmit port diametric plane may be ignored; therefore, it may be considered that $\vec{J}_T^{(1)}=\vec{J}_T^{(2)}$, and $\vec{M}_T^{(1)}=\vec{M}_T^{(2)}$; in conclusion, the following formula is satisfied:

$$\hat{n}\times L^E(\vec{J}_R^{(2)},\vec{M}_R^{(2)})|_{P\in S_V}=\hat{n}\times L^E(\vec{J}_R^{(1)},\vec{M}_R^{(1)})|_{P\in S_V}+\hat{n}\times \vec{E}_V^{(1)}|_{P\in S_V}-\hat{n}\times L^E(\vec{J}_V,0)|_{P\in S_V} \quad \text{Formula (5).}$$

As can be seen from Formula (5), selecting an appropriate shape and size of the transition band can reduce equivalent surface current distribution $\vec{J}_R^{(2)}$ and magnetic current distribution $\vec{M}_R^{(2)}$ that are generated on a receive port diametric plane of a receive antenna array (for example, the second antenna group 53) by a transmit antenna array (for example, the first antenna group 52), thereby reducing interference caused by the transmit antenna array to the receive antenna array, and increasing isolation of the antenna array 50.

In this embodiment of the present invention, a distance between the transmit antenna array and the receive antenna array (that is, the distance between the first antenna group 52 and the second antenna group 53) is calculated by using a wavelength as a unit, and the distance between the transmit antenna array and the receive antenna array determines a quantity of transition bands 55 that need to be disposed and an opening width of each groove 554. As an embodiment of the present invention, one type of design of the transition band 55 is: the opening width of the groove 554 of the transition band 55 is a quarter wavelength, and the entire transition band is of a symmetric V-shaped structure. It may be understood that, the foregoing design parameter is merely one specific embodiment of the antenna array 50, and this application is not merely limited to the foregoing design parameter. The size of the transition band 55 is designed according to a size of a structure of the antenna array 50. All design parameters satisfying the array structure shall fall within the protection scope of this application, and no further details are provided herein.

For example, it is set that the distance between the first antenna group 52 and the second antenna group 53 is d, and that a wavelength is λ, and if the distance d between the transmit antenna array and the receive antenna array is an integer multiple of λ/4, a quantity of the transition bands 55 is M=d/(λ/4), and an opening width of each groove 554 is λ/4. If the distance d between the transmit antenna array and the receive antenna array is not an integer multiple of λ/4, a quantity M of the transition bands 55 is obtained by rounding (specifically, rounding an absolute value of the parameter down) d/(λ/4) and adding one to an obtained integer, an opening width of each of the former (M−1) transition bands 55 is λ/4, and a width of an opening of the last transition band 55 is d−(M−1)*24. Specifically, for example, if the distance d between the transmit antenna array and the receive antenna array is 7λ/8, four transition bands 55 need to be disposed, including three transition bands whose grooves have opening widths of λ/4, and one transition band whose groove has an opening width of λ/8.

In another embodiment of the present invention, it may be understood that, heights of transition bands may be different, and the transition bands may be arranged between the first antenna group 52 and the second antenna group 53 in descending order of height, or arranged between the first antenna group 52 and the second antenna group 53 in ascending order of height, or arranged between the first antenna group 52 and the second antenna group 53 in another feasible manner.

In another embodiment of the present invention, an opening width of the groove 554 of the transition band 55 is one eighth of a wavelength, a quarter wavelength, one third of a wavelength, a half of a wavelength, or another width. In addition, an entire shape of the transition band 55 is a symmetric V-shaped structure, and a shape of the transition band 55 in a cross-sectional direction (for example, a direction presented by a transition band 85 in FIG. 4) may be a symmetric V-shaped structure.

Figure 3:
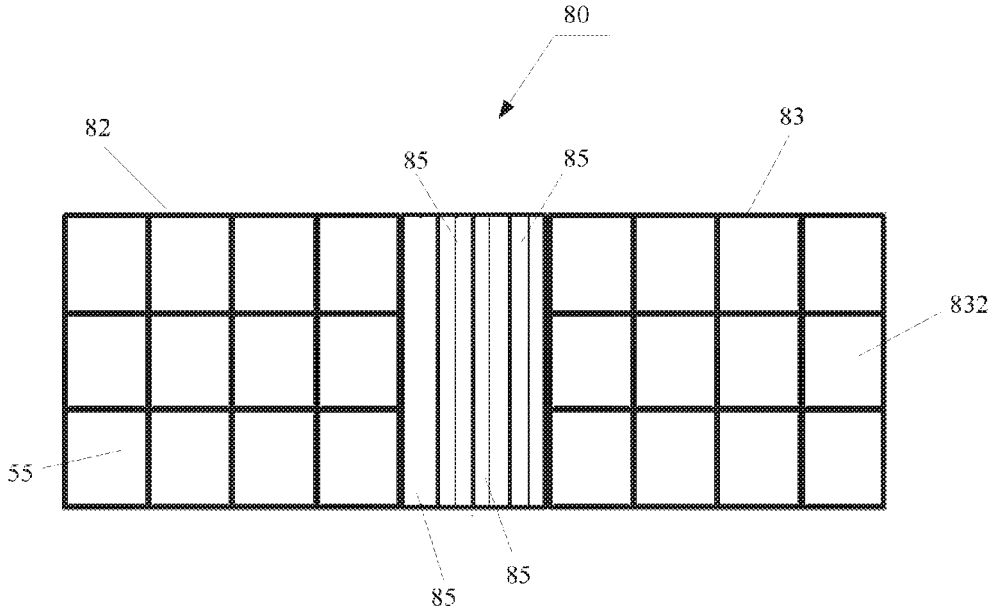
FIG. 3 is a top view of an antenna array according to another embodiment of the present invention.
Figure 4:
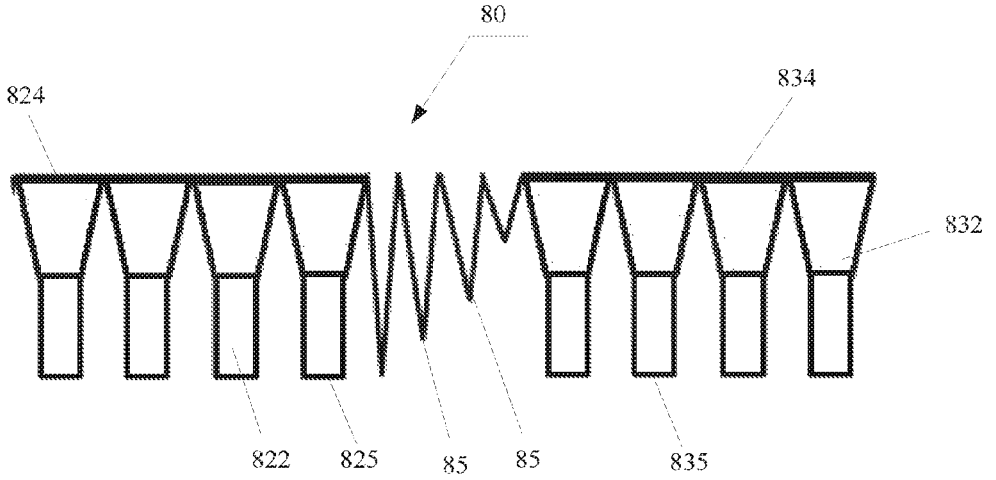
FIG. 4 is a front view of the antenna array shown in FIG. 3 of the present invention.

Referring to FIG. 3 and FIG. 4 together, another specific embodiment of the present invention provides an antenna array 80, where the antenna array 80 is a phased array antenna (Phased Array Antenna, PAA), and includes a first antenna group 82, a second antenna group 83, and a transition band 85 located between the first antenna group 82 and the second antenna group 83. In this embodiment of the present invention, the first antenna group 82 is used as a signal transmit antenna for transmitting a signal, and may be a phased array antenna of a 4*4 array. The first antenna group 82 includes antennas 822. There are 16 antennas 822, and each of the antennas 822 is a pyramidal horn antenna.

In this embodiment of the present invention, the second antenna group 83 is used as a signal receive antenna for receiving a signal, and may be a phased array antenna of a 4*4 array. The second antenna group 83 includes several antennas 832, there are 16 antennas 832, and each of the antennas 832 is a pyramidal horn antenna.

In this embodiment of the present invention, there are four transition bands 85, and each of the transition bands 85 is of a symmetric V-shaped structure. Heights of the transition bands 85 may be different, and the transition bands 85 are arranged between the first antenna group 82 and the second antenna group 83 in descending order of height. A shape and a structure of the transition band 85 are the same as a shape and a structure of the transition band 55 in the embodiment shown in FIG. 2. Specific descriptions have been fully provided in the foregoing embodiment, and no further details are provided herein.

In addition, a height of each of the transition bands 85 is less than or equal to a height of the antenna 822 and a height of the antenna 832, that is, the height of the transition band 85 is less than or equal to a distance between a first transmit port diametric plane 824 and a second transmit port diametric plane 825 of the antenna 822, and the height of the transition band 85 is less than or equal to a distance between a first receive port diametric plane 834 and a second receive port diametric plane 835 of the antenna 832. In this way, the transition band 85 does not affect beamforming or beam scanning, but plays a role of wave trapping; therefore, field distribution formed by a current of the transmit port diametric plane on the receive port diametric plane becomes weak, thereby reducing strength of a signal sneaking onto the receive port diametric plane, and further increasing isolation of the antenna array 80.

In this embodiment of the present invention, a distance between the transmit antenna array and the receive antenna array (that is, the distance between the first antenna group 82 and the second antenna group 83) is equal to one wavelength, that is, an integer multiple of ¼ of a wavelength, and therefore there are four transition bands 85, and an opening width of a groove of each transition band 85 is a quarter wavelength.

To sum up, in the phased array system 100 provided in an embodiment of the present invention, the antenna array may be used in the phased array system 100 in which a distance between transmit and receive antennas is relatively small and an isolation requirement is relatively high, and specifically has the following beneficial effects:

(1) Under the premise that a size is not increased and beamforming and beam scanning of an array are not affected, a problem that isolation between transmit and receive antennas (arrays) in the phased array system 100, especially in a small-scale microwave system, is insufficient is solved.

(2) The antenna array is integrated into the phased array system 100, a distance between the transmit and receive antennas (arrays) and sizes of the antennas do not need to be increased; therefore, a size of the phased array system 100 is not increased either.

(3) No filter needs to be disposed at a rear end of the receive antenna (array), and a cost of the antenna array is low; therefore, an entire system cost is reduced, relatively small area of a radio frequency board is occupied, and the size of the system cannot be controlled to be within an expected range.

Finally, it should be noted that the foregoing embodiments are merely intended for describing the technical solutions of the present invention but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof; however, these modifications or replacements do not make the essence of corresponding technical solutions depart from the spirit and scope of the technical solutions in the embodiments of the present invention.

What is claimed is:

1. An antenna array, comprising a first antenna group and a second antenna group, wherein the antenna array further comprises a transition band, wherein the transition band is located between the first antenna group and the second antenna group and is connected to the first antenna group and the second antenna group, a height of the transition band is less than or equal to a height of the first antenna group and a height of the second antenna group, the transition band comprises a first transition sheet and a second transition sheet, one end of the first transition sheet is connected to one end of the second transition sheet to form the transition band of a V-shaped structure, and the other end of the first transition sheet is connected to the first antenna group.

2. The antenna array according to claim 1, wherein the first transition sheet is connected to the second transition sheet to form a V-shaped groove; and when there is one transition band, one end of the first transition sheet of the transition band is connected to one end of the second transition sheet, the other end of the first transition sheet is connected to the first antenna group, the other end of the second transition sheet is connected to the second antenna group, and a width of the groove is equal to a distance between the first antenna group and the second antenna group.

3. The antenna array according to claim 1, wherein the first transition sheet is connected to the second transition sheet to form a V-shaped groove; and when there are two or more transition bands, the transition bands are connected in a head-to-tail manner, a second transition sheet of one transition band is connected to a first transition sheet of a next transition band, a first transition sheet of a transition band located in the first place is connected to the first antenna group, a second transition sheet of a transition band located in the last place is connected to the second antenna group, and a sum of widths of grooves is equal to a distance between the first antenna group and the second antenna group.

4. The antenna array according to claim 1, wherein the first antenna group comprises several transmit antennas, each transmit antenna comprises a first transmit port diametric plane and a second transmit port diametric plane, and the first transmit port diametric plane and the second transmit port diametric plane are end surfaces of two opposite ends of the transmit antenna and are parallel to each other; and the second antenna group comprises several receive antennas, each receive antenna comprises a first receive port diametric plane and a second receive port diametric plane, and the first receive port diametric plane and the second receive port diametric plane are end surfaces of two opposite ends of the receive antenna and are parallel to each other.

5. The antenna array according to claim 4, wherein the first transition sheet is connected to the second transition sheet to form a V-shaped groove; and when there is one transition band, the first transition sheet and the second transition sheet of the transition band are connected to an edge of the first transmit port diametric plane of the transmit antenna and an edge of the first receive port diametric plane of the receive antenna respectively, to connect the transmit antenna and the receive antenna, and a width of the groove is equal to a distance between the first transmit port diametric plane and the first receive port diametric plane.

6. The antenna array according to claim 4, wherein the first transition sheet is connected to the second transition sheet to form a V-shaped groove; and when there are two or more transition bands, the transition bands are connected in a head-to-tail manner, a first transition sheet of a transition band located in the first place is connected to an edge of the first transmit port diametric plane of the transmit antenna, a second transition sheet of a transition band located in the last place is connected to an edge of the first receive port diametric plane of the receive antenna, and a sum of widths of grooves of the transition bands is equal to a distance between the first transmit port diametric plane and the first receive port diametric plane.

7. The antenna array according to claim 4, wherein a distance between the first transmit port diametric plane and the second transmit port diametric plane of the transmit antenna is equal to the height of the first antenna group, the height of the transition band is less than or equal to the distance between the first transmit port diametric plane and the second transmit port diametric plane of the transmit antenna, and the transition band is located between the first transmit port diametric plane and the second transmit port diametric plane; and a distance between the first receive port diametric plane and the second receive port diametric plane of the receive antenna is equal to the height of the second antenna group, the height of the transition band is less than or equal to the distance between the first receive port diametric plane and the second receive port diametric plane of the receive antenna, and the transition band is located between the first receive port diametric plane and the second receive port diametric plane.

8. The antenna array according to claim 1, wherein heights of transition bands are different, and the transition bands are arranged between the first antenna group and the second antenna group in descending order of height, or arranged between the first antenna group and the second antenna group in ascending order of height.

9. A phased array system, comprising a signal transmitter, a signal receiver, and an antenna array, wherein the antenna array comprises a first antenna group and a second antenna group, and the first antenna group and the second antenna group are electrically connected to the signal transmitter and the signal receiver respectively; and the antenna array further comprises a transition band, the transition band is located between the first antenna group and the second antenna group and is connected to the first antenna group and the second antenna group, a height of the transition band is less than or equal to a height of the first antenna group and a height of the second antenna group, the transition band comprises a first transition sheet and a second transition sheet, one end of the first transition sheet is connected to one end of the second transition sheet to form the transition band of a V-shaped structure, and the other end of the first transition sheet is connected to the first antenna group.

10. The phased array system according to claim 9, wherein the first transition sheet is connected to the second transition sheet to form a V-shaped groove; and when there is one transition band, one end of the first transition sheet of the transition band is connected to one end of the second transition sheet, the other end of the first transition sheet is connected to the first antenna group, the other end of the second transition sheet is connected to the second antenna group, and a width of the groove is equal to a distance between the first antenna group and the second antenna group.

11. The phased array system according to claim 9, wherein the first transition sheet is connected to the second transition sheet to form a V-shaped groove; and when there are two or more transition bands, the transition bands are connected in a head-to-tail manner, a second transition sheet of one transition band is connected to a first transition sheet of a next transition band, a first transition sheet of a transition band located in the first place is connected to the first antenna group, a second transition sheet of a transition band located in the last place is connected to the second antenna group, and a sum of widths of grooves is equal to a distance between the first antenna group and the second antenna group.

12. The phased array system according to claim 9, wherein the first antenna group comprises several transmit antennas, each transmit antenna comprises a first transmit port diametric plane and a second transmit port diametric plane, and the first transmit port diametric plane and the second transmit port diametric plane are end surfaces of two opposite ends of the transmit antenna and are parallel to each other; and the second antenna group comprises several receive antennas, each receive antenna comprises a first receive port diametric plane and a second receive port diametric plane, and the first receive port diametric plane and the second receive port diametric plane are end surfaces of two opposite ends of the receive antenna and are parallel to each other.

13. The phased array system according to claim 12, wherein either of the transmit antenna and the receive antenna is any kind of: a pyramidal horn antenna, a slotted waveguide antenna, and a helical antenna.

14. The phased array system according to claim 12, wherein the first transition sheet is connected to the second transition sheet to form a V-shaped groove; and when there is one transition band, the first transition sheet and the second transition sheet of the transition band are connected to an edge of the first transmit port diametric plane of the transmit antenna and an edge of the first receive port diametric plane of the receive antenna respectively, to connect the transmit antenna and the receive antenna, and a width of the groove is equal to a distance between the first transmit port diametric plane and the first receive port diametric plane.

15. The phased array system according to claim 12, wherein the first transition sheet is connected to the second transition sheet to form a V-shaped groove; and when there are two or more transition bands, the transition bands are connected in a head-to-tail manner, a first transition sheet of a transition band located in the first place is connected to an edge of the first transmit port diametric plane of the transmit antenna, a second transition sheet of a transition band located in the last place is connected to an edge of the first receive port diametric plane of the receive antenna, and a sum of widths of grooves of the transition bands is equal to a distance between the first transmit port diametric plane and the first receive port diametric plane.

16. The phased array system according to claim 12, wherein a distance between the first transmit port diametric plane and the second transmit port diametric plane of the transmit antenna is equal to the height of the first antenna group, the height of the transition band is less than or equal to the distance between the first transmit port diametric plane and the second transmit port diametric plane of the transmit antenna, and the transition band is located between the first transmit port diametric plane and the second transmit port diametric plane; and a distance between the first receive port diametric plane and the second receive port diametric plane of the receive antenna is equal to the height of the second antenna group, the height of the transition band is less than or equal to the distance between the first receive port diametric plane and the second receive port diametric plane of the receive antenna, and the transition band is located between the first receive port diametric plane and the second receive port diametric plane.

17. The phased array system according to claim 9, wherein heights of transition bands are different, and the transition bands are arranged between the first antenna group and the second antenna group in descending order of height, or arranged between the first antenna group and the second antenna group in ascending order of height.

18. The phased array system according to claim 9, wherein the signal transmitter comprises:

a signal transmitting module, configured to generate and send a radio frequency signal;

a power splitter, electrically connected to the signal transmitting module; and configured to receive the signal input by the signal transmitting module, and split the input signal energy into two or more channels of signals outputting equal or unequal energy;

several phase shifters, each electrically connected to the power splitter; and receiving the signals output by the power splitter, and adjusting phases of the signals; and several power amplifiers, each electrically connected to each corresponding phase shifter and the first antenna group; and configured to receive the signals output by the phase shifters, and amplify the signals output by the phase shifters, to obtain signals applied to the first antenna group.

19. The phased array system according to claim 9, wherein the signal receiver comprises:

several low noise amplifiers, electrically connected to the second antenna group; and receiving a signal from the second antenna group, and amplifying the signal;

several phase shifters, each electrically connected to each corresponding low noise amplifier; and configured to receive signals output by the low noise amplifiers, and adjust phases of the signals;

a combiner, electrically connected to the phase shifters; and receiving two or more channels of signals input by the phase shifters, and combining the input two or more channels of signal energy into one channel of output signal; and a signal receiving module, electrically connected to the combiner; and receiving the signal input by the combiner, storing the signal, and providing the signal for the phased array system to use.

* * * * *